United States Patent [19]

Burgmann et al.

[11] Patent Number: 4,801,924

[45] Date of Patent: Jan. 31, 1989

[54] TRANSMITTER PROGRAMMER CONNECT SYSTEM

[75] Inventors: Thomas A. D. Burgmann, Mississauga; Gary Lennartz, Rexdale, both of Canada

[73] Assignee: Dicon Systems Limited, Toronto, Canada

[21] Appl. No.: 145,929

[22] Filed: Jan. 20, 1988

[30] Foreign Application Priority Data

Nov. 9, 1987 [CA] Canada ..... 551372

[51] Int. Cl.[4] ..... G08B 19/00; G08B 1/08

[52] U.S. Cl. ..... 340/521; 340/539; 340/506; 340/531

[58] Field of Search ..... 340/521, 539, 531, 506, 340/518, 825.06, 532–538, 825.22, 825.27, 825.34, 825.36

[56] References Cited

U.S. PATENT DOCUMENTS

| | | | |
|---|---|---|---|
| 4,354,252 | 10/1982 | Lamb et al. | 340/539 |
| 4,442,426 | 4/1984 | Heuschmann et al. | 340/539 |
| 4,465,904 | 8/1984 | Gottsegen et al. | 340/518 |
| 4,581,606 | 4/1986 | Mallory | 340/506 |
| 4,672,365 | 6/1987 | Gehman et al. | 340/539 |
| 4,737,770 | 4/1988 | Brunius et al. | 340/539 |

*Primary Examiner*—Donnie L. Crosland
*Attorney, Agent, or Firm*—Lee & Smith

[57] ABSTRACT

A security system for sensing the status of various security detectors used in, for example, home security such as fire, intrusion, emergency and appliance operation protection is disclosed. The detectors transmit, usually via radio frequency, various messages to a central monitor. To enable proper communication, the transmitters are programmed to transmit messages unique to the originating detector. The transmitters may be programmed at one station and then moved to the detector for insertion therein. During this transport, it is important that a volatile memory of the transmitter be retained. This is accomplished by a low power source. A disarming device is provided to disarm the transmitter during transport to prevent the transmitter from draining a short term power source by transmitting a message. This avoids the loss of any programmed information in the evaporative memory.

3 Claims, 4 Drawing Sheets

TRANSMITTER PROGRAMMER CONNECT SYSTEM

FIELD OF THE INVENTION

This invention relates to a security system and transmitters for use with the system.

BACKGROUND OF THE INVENTION

Security systems which involve the use of transmitters for transmitting in a wireless system information from sensors to central monitors are becoming increasingly popular in residential communities. An example of such a system is disclosed in U.S. Pat. No. 4,581,606. In that system, the transmitter is programmed with information by a programming unit, removed from the unit and inserted in the particular sensor. The particular sensor, when it goes into an alarm condition, causes a transmitter to transmit an appropriate message to the central monitor to advise of the problem or status of the sensor.

It is therefore necessary to transport the programmed transmitter from the programming unit to the sensor or detector. An economical form of memory for the transmitter is a volatile random access memory. Hence a low power voltage source may be provided on the transmitter to maintain the memory during transport so that the program data is not lost. However, as soon as the transmitter is removed from the programming device, there is the possibility that the transmitter may be in a mode to commence transmission of its status which would immediately drain the low power voltage source and result in loss of memory.

SUMMARY OF THE INVENTION

The invention is useful in a security system for sensing the status of various security detectors, which detect fire, door/window opening, intrusion, emergency/medical alert, appliance operation and the like. A central monitor for monitoring the detectors on a regular basis communicates with the detectors via a transmitter provided on each of the detectors and a receiver in the monitor for receiving transmissions from a respective transmitter. Means programs a volatile programmable memory of each of the transmitters to characterize transmission of a message peculiar to a corresponding detector when the transmitter is actuated to transmit the message. The receiver recognizes the transmitted message from each of the transmitters and identifies the detector associated with the transmitter. An electrical coupling for coupling each of the transmitters to the programming means is provided. Each transmitter has a short-term, low power device for powering the volatile memory of the transmitter during transport after it is uncoupled from the programming means, and until the transmitter is coupled to a power source of one of the detectors.

The improvement, in accordance with an aspect of this invention, comprises means for disarming the transmitter during its transport to a detector to prevent the transmitter draining the short-term power source by transmitting a message during transport and thereby retaining program information in the volatile memory. The electrical coupling has means for actuating the disarming means when the transmitter is uncoupled from the programming means and before the transmitter can commence a transmission of a message. The electrical coupler comprises a socket having a plurality of electrical contacts and the transmitter has a corresponding plurality of electrical prongs for insertion into the socket and contacting the electrical contacts. The actuating means comprises one of the prongs being shorter than the remaining prongs whereby on withdrawal of the transmitter, the shorter prong breaks contact first with the socket electrical contact to actuate the disarming means prior to remaining prongs breaking contact with the socket electrical contacts.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
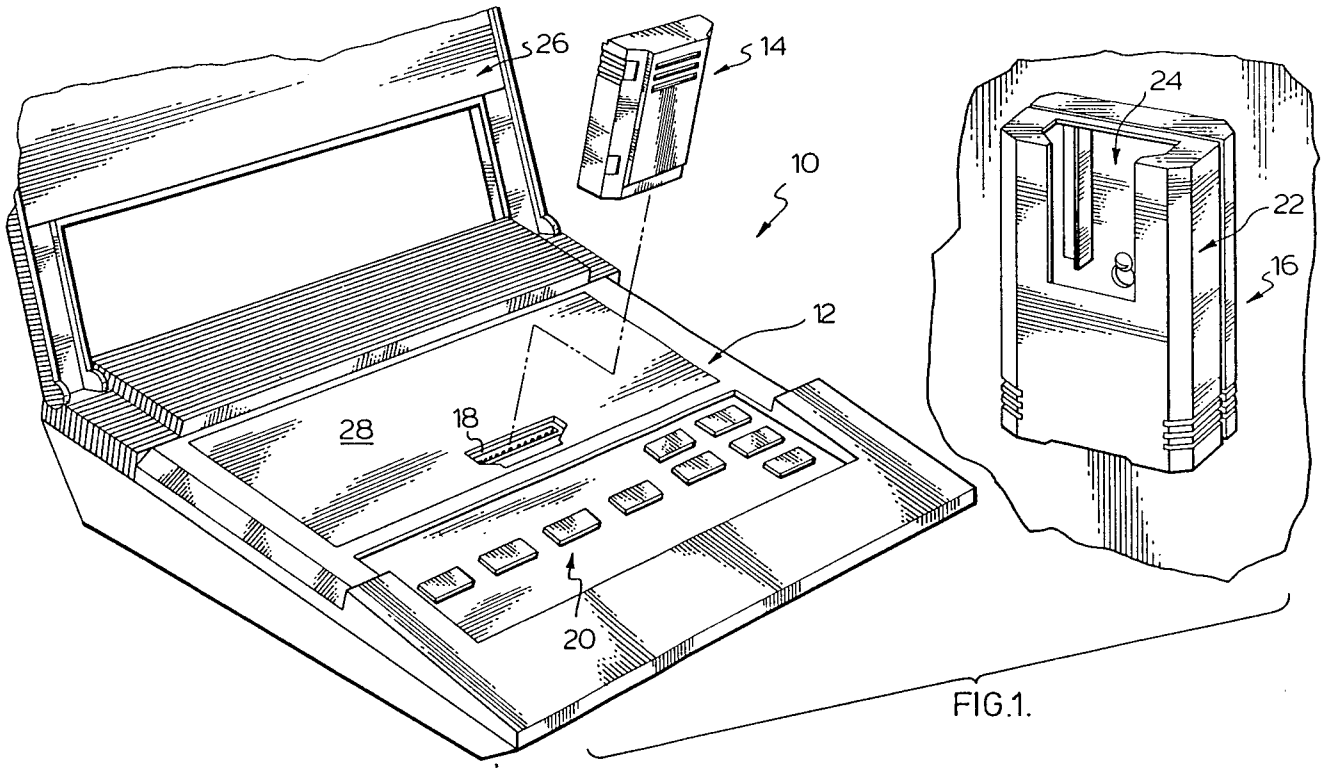
FIG. 1 is a perspective view of a transmitter to be programmed by the central monitor and then readied for transport to a detector case.
Figure 2:
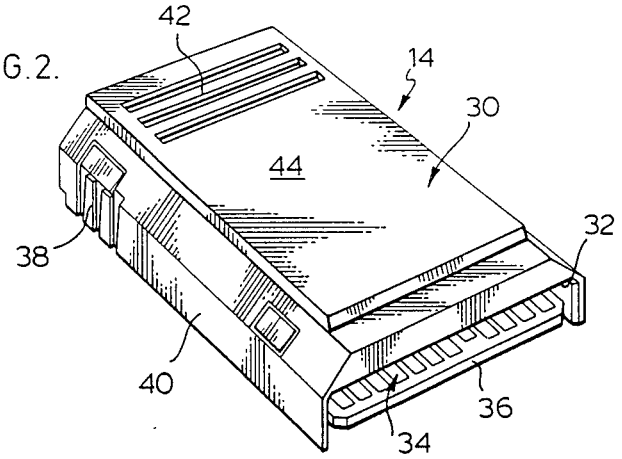
FIG. 2 is a perspective view of the transmitter.

The security system 10, according to this invention as shown in FIG. 1, comprises the principal components of a central monitor 12, a transmitter 14 and a detector unit 16. The central monitor 12, in accordance with the preferred embodiment of the invention, includes a device for programming the transmitter 14. Programming is accomplished by inserting the transmitter into the electrical socket opening 18, then by use of the keyboard 20 appropriate information may be loaded into the programmable memory of the transmitter 14. The transmitter 14 is then transported to the mounted detector 16 and inserted beneath the display case front 22 and subsequently visible through the opening 24 of the display case. When the central monitor 12 is in use, the hinged lid 26 is lowered onto the face 28 of the monitor to cover the programming receptacle 18 and hence provide an attractive finish to the unit.

Figure 3:
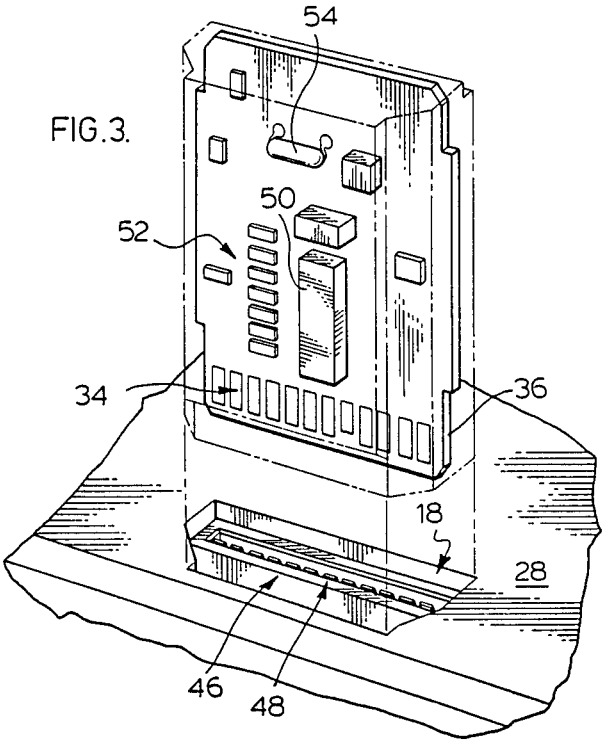
FIG. 3 is a perspective view of the circuit board of the transmitter in line for insertion in the socket of the programming device.

The transmitter 14 comprises a case 30 having an open bottom end 32. A plurality of electrical prongs generally designated 34 are presented on a substrate or circuit board 36 and accessible through the opening 32. The body portion 30 of the transmitter includes finger grips 38 on each side 40 thereof and also finger grips 42 on the front face 44 of the body. The transmitter is therefore readily manipulated by hand for insertion in the programming socket 18 of the central monitor face 28, as shown in FIG. 3. The socket 18 has an outline resembling the cross-sectional shape of the transmitter body to provide for a one way insertion of the transmitter body into the opening 18. By inserting the transmitter in this manner, the plurality of prongs 34 on the substrate 36 are aligned with the electrical socket 46 having the corresponding plurality of electrical contacts 48. The board 36 which carries the electrical prongs may be a printed circuit board having leads to the various electronic components of the transmitter, such as the integrated circuit chip 50 resistor network 52 and a short-term low power source 54 which may be in the form of a capacitor.

Figure 4:
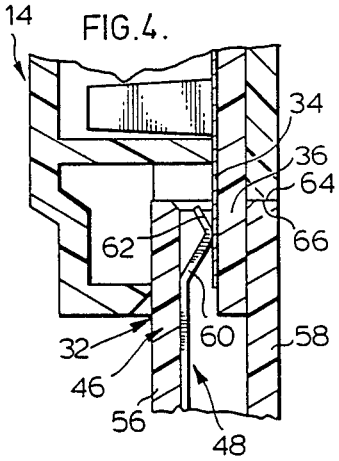
FIG. 4 is a section through the transmitter base with the prong member inserted in the electrical contact of the socket.

With reference to FIG. 4, the socket 46 comprises opposing walls 56 and 58. Either or both of walls 56 and 58 may be provided with a spring loaded electrical contact 60 for engaging the prongs of the transmitter when inserted in the socket 46. Each of a plurality of electrical contacts 48 is then provided with the resilient contact portion 60 with lead-in portion 62. According to the embodiment shown in FIG. 4, electrical contact is only provided on one side of the socket. The transmitter 14 with its opening indicated at 32, is pushed into the opening 18 of the central monitor to permit insertion of the base plate 36 with the prongs 34 so that the prongs 34 engage the respective electrical contacts 48. The body portion of the transmitter has a stop 64 which engages the upper edge 66 of the wall 58 to locate insertion of the transmitter into the socket 46.

Figure 5:
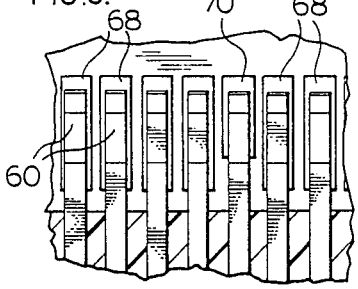
FIG. 5 shows the relative relationship of the prongs of the transmitter within the electrical socket of the programming device.

As shown in the sectional view of FIG. 5, the individual prongs 68 of the transmitter are all in contact with the respective electrical contacts 60 of the socket 46. However, one of the contacts 70 is noticeably shorter than the remaining contacts 68.

Figure 6:
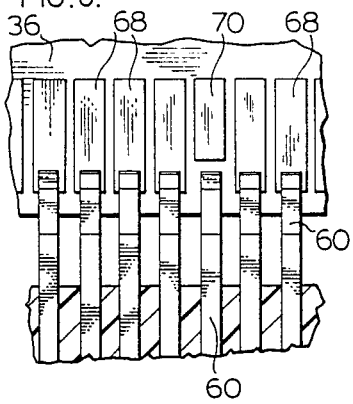
FIG. 6 shows the breaking of contact of the shorter prong of a series of prongs for the transmitter as it is withdrawn from the socket.

The action of the shorter prong 70 becomes apparent in FIG. 6. When the base 36 of the transmitter 14 is withdrawn from the socket 18, the first prong to loose contact with the corresponding electrical contact 60 of the socket is prong 70. As shown, contact 60 is actually touching the insulative board 36. Meanwhile, all other contacts 60 still are in contact with the corresponding prongs 68. By virtue of the shorter prong breaking contact first with the socket, a signal is generated for the controlling circuitry to disarm the transmitter to prevent any further transmission until the transmitter is placed in the socket of the detector.

Figure 7:
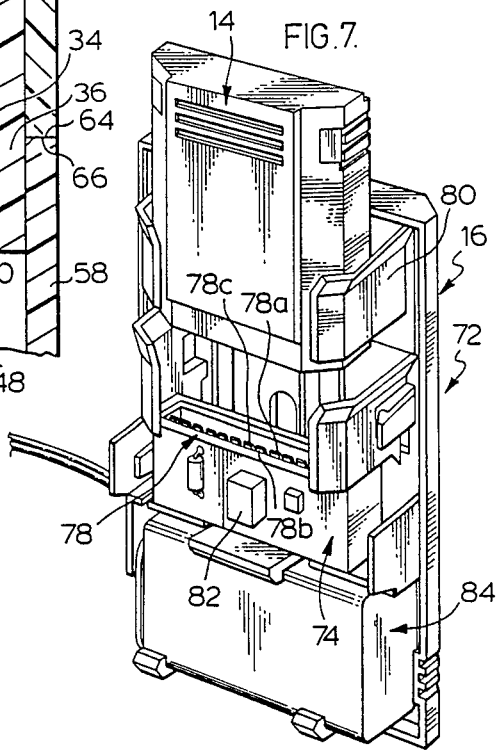
FIG. 7 is a perspective view of the detector having the transmitter inserted therein.

With reference to FIG. 7, the detector base 72 has mounted thereon a socket 74 containing a plurality of electrical contacts 78. A guide in the form of clips 80 are provided for guiding insertion of the programmed transmitter 14 into the socket 74. The plate 36 is guided into the socket where the respective prongs 68 and 70 contact the corresponding electrical contacts of the socket in the same manner as that shown in FIG. 5. The socket 74 also includes electronic components such as the integrated circuit portion 82 which works as the sensory part of the system for detecting a particular condition and causing a transmission through the transmitter 14, as for example in the manner discussed in U.S. Pat. No. 4,581,606.

The short-term low power source 54, which may be in the form of a chargeable capacitor as shown in FIG. 3, and which as will be discussed, may be used in powering the volatile memory of the transmitter during transport, may be recharged as soon as the transmitter is fully seated in the socket 74. With all the prongs 68 in contact with the respective contacts 78 of the socket 74, the battery 84 of the detector 16 resumes powering of the transmitter 14.

Figure 8:
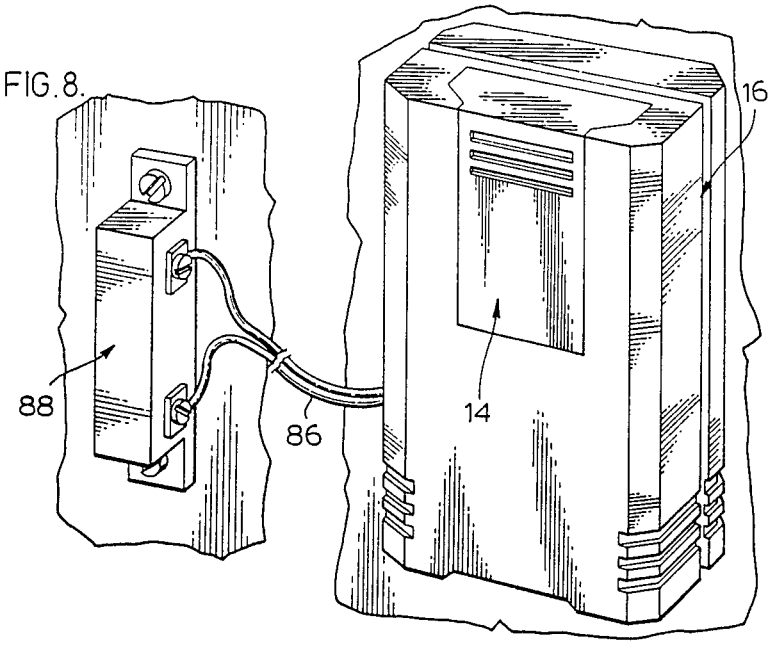
FIG. 8 is a perspective view of the assembled detector specifically adapted to sense door opening.

As shown in FIG. 8 with the transmitter 14 properly housed in the display case of the detector 16, the system is ready for normal use. As per the embodiment shown in FIG. 8, the detector 16 has electrical leads 86 to a reed switch 88 which may be used in conjunction with the magnet mounted on the door so as to detect opening and closing of the door. The reed switch 88 through the electrical leads 86 is connected to the electronic component circuitry of the socket 74. When the reed switch is opened and/or closed, appropriate indication is provided in the circuitry of the socket 74 to cause, if called for, a suitable transmission through the transmitter 14 to the central monitor. The memory of the transmitter is programmed to include information such that when a transmission is called for, the assembled and transmitted message includes information which identifies the particular detector with which the transmitter is associated. Aside from the detector going into the alarm condition in causing a transmission, the transmitter may also be programmed to transmit on a regular interval a message to the central monitor to indicate its status. Such transmission may take place on an hourly basis or on a regular basis at a shorter time interval. After the transmitter is programmed, there may be sufficient delay during transport that if the transmitter were not frozen, the system could be actuated to transmit a normal status message to the central monitor. This would result in sufficient current draw to drain the short-term low power source 54. Since the purpose of the low power source 54 is to maintain power on the volatile memory of the integrated circuit chip 50 of the transmitter, the loss in power would wipe out the programmed information stored in the random access memory. Hence any future transmission from the transmitter would be useless.

To prevent transmissions while a transmitter is in transport from the program to the detector, the short prong device acts as an actuating system to cause a means to disarm the transmitter.

Figure 9:
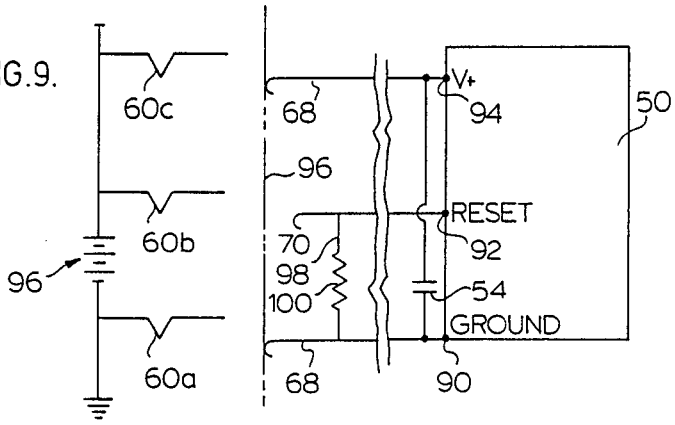
FIG. 9 is a schematic of the circuitry associated with the prongs of the transmitter.

With reference to FIG. 9, the integrated circuit 50 of the transmitter includes a plurality of input terminals 90, 92, 94, etc. Electrically connected to these terminals 90, 92, 94, etc. are the respective prongs 68, 70, and 68 etc., the shorter prong 70 being illustrated as such relative to the reference line 96. Electrical contacts 60*a*, 60*b*, 60*c*, etc. of the socket are shown. When the transmitter is positioned in the socket 46, prongs 68 are in contact with respect to the terminal 60 as well as prong 70. Prong 60*a* is connected to ground whereas prong 60*b* is at the potential of the power source generally represented at 96. Prong 60*c*, etc. is in contact with another corresponding prong 68 where the additional contacts and prongs intercommunicate between the circuitry of the programming device and the integrated circuit chip 50 and other related components including, for the example, the resistors 52 of the programming network. After the transmitter is fully programmed, and it is removed from the socket, the first prong to break from the contact is prong 70. As it breaks from contact 60*b*, by virtue of line 98 through resistor 100, the potential in prong 70 goes to ground through electrical contact 60*a*. This provides a signal in the circuit 50 to actuate a disarming of the transmitter associated with the integrated circuit 50.

Figure 10:
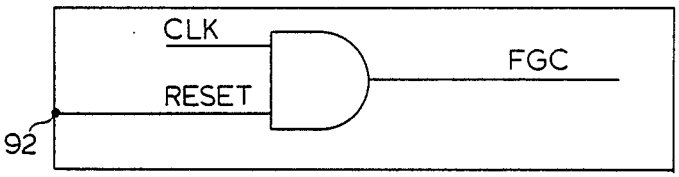
FIG. 10 is a gate diagram illustrating the logic within the integrated circuit which disarms the transmitter during transport.

With reference to FIG. 10, the internal logic of the IC 50 includes a gate system as shown, where CLK represents the clock pulse and RESET indicates the voltage at prong 70. The output of the gate is FGC (Frame Connector Clock) which, when RESET line is high, then FGC equals the clock input whereby the normal functions of the transmitter occur. However, when the RESET goes low, which is caused by prong 70 disconnecting from the contact 60*b*, the FGC output goes to zero. When there is no clock pulse input to IC 50, insofar as the transmitter function is concerned, then no transmissions can occur. When the transmitter is inserted in the detector 16, the RESET goes high resulting in FGC equalling the clock input so that the transmitter may resume its normal functions.

Hence the short prong acts as a device for actuating the disarming device of the IC which may be in the form of the logic gate of the type illustrated in FIG. 10. The disarming device is actuated before the remaining relevant prongs of the set 34 disconnect from the contacts 60*a*, 60*c*, etc. of the programming device. This ensures that the logic of the circuitry is at a known state for the low power source, capacitor 54 to commence maintaining the circuit operation with the transmitter "frozen" during transport. As a result all aspects of the circuitry remain synchronous. When the transmitter is inserted in the detector, all other prongs 68 are in contact with the respective contacts 78*a*, 78*c*, etc. before shorter prong 70 contacts the respective contact 78*b*. This ensures that the circuitry is powered back up in the normal mode before RESET through the logic gate of FIG. 10, so that proper start-up of the transmitter circuitry in the transmitter 14 is accomplished.

In accordance with this invention, an economical system is provided to ensure that the short-term low power source for the volatile memory of the integrated circuit 50 of the transmitter is not lost while the transmitter is being transported from the programming device to the respective detector.

Although preferred embodiments of the invention have been described herein in detail, it will be understood by those skilled in the art that variations may be made thereto without departing from the spirit of the invention or the scope of the appended claims.

We claim:

1. In a security system for sensing the status of various security detectors which detect fire, door/window opening, intrusion, emergency/medical alert, appliance operation and the like; a central monitor for monitoring said detectors on a regular basis, said central monitor communicating with said detectors via a transmitter provided on each of said detectors and a receiver in said monitor for receiving transmissions from a respective transmitter, means for programming an volatile programmable memory of each of said transmitters to characterize its transmission of a message peculiar to a corresponding detector when said transmitter is actuated to transmit said message, said receiver recognizing said transmitted message from each of said transmitters and identifying the detector associated with said transmitter, an electrical coupling for coupling each of said transmitters to said programming means, each transmitter having a short-term low power device for powering said volatile memory of said transmitter during transport after it is uncoupled from said programing means and until said transmitter is coupled to a power source of one of said detectors, the improvement comprising means for disarming said transmitter during said transport to a detector to prevent said transmitter draining said short-term power source by transmitting a message during said transport and thereby retaining programmed information in said volatile memory, said electrical coupling having means for actuating said disarming means when said transmitter is uncoupled from said programming means and before said transmitter can commence a transmission of a message, said electrical coupler comprising a socket having a plurality of electrical contacts and said transmitter having a corresponding plurality of electrical prongs for insertion into said socket and contacting said electrical contacts, said actuating means comprising one of said prongs being shorter than the remaining prongs whereby upon withdrawal of said transmitter, said shorter prong breaks contact first with said socket electrical contacts to actuate said disarming means prior to remaining prongs breaking contact with said socket electrical contacts.

2. In a security system of claim 1, said short-term low power device is a capacitor which is charged while said transmitter is being programmed by said programming means.

3. In a security system of claim 1, said disarming means comprising a gate system which blocks clock input to said transmitter upon said shorter prong breaking contact with said socket electrical contact.

* * * * *